US005228763A

United States Patent [19]

Gingold

[11] Patent Number: 5,228,763

[45] Date of Patent: Jul. 20, 1993

[54] EXTENDABLE STORAGE ELEMENT

[76] Inventor: Lawrence Gingold, 92 40 Queens Blvd., Rego Park, N.Y. 11374

[21] Appl. No.: 860,171

[22] Filed: Mar. 30, 1992

[51] Int. Cl.[5] ..... A47F 5/00

[52] U.S. Cl. ..... 312/266; 312/247; 312/282

[58] Field of Search ..... 312/266, 312, 247, 282, 312/306, 272

[56] References Cited

U.S. PATENT DOCUMENTS

| | | | |
|---|---|---|---|
| 876,159 | 1/1908 | Erickson | 312/266 |
| 1,847,494 | 3/1932 | Paoli | 312/272 |
| 2,635,030 | 4/1953 | Stebbins et al. | 312/266 |
| 3,857,623 | 12/1974 | Schneller | 312/266 |
| 3,902,773 | 9/1975 | Gondek | 312/266 |
| 4,076,351 | 2/1978 | Wyant | 312/319 |
| 4,805,906 | 2/1989 | Wiczer et al. | 312/282 |
| 4,915,461 | 4/1990 | Kingsbordugh et al. | 312/247 |
| 5,058,846 | 10/1991 | Close | 312/247 |
| 5,076,533 | 12/1991 | Schubert | 312/266 |

*Primary Examiner*—Victor N. Sakran
*Attorney, Agent, or Firm*—Ilya Zborovsky

[57] ABSTRACT

A storage element includes a body and a structure which moves the body between retracted and extended positions and includes a motor drive and two parallel links which move parallel to one another during the movement of the body.

12 Claims, 2 Drawing Sheets

EXTENDABLE STORAGE ELEMENT

BACKGROUND OF THE INVENTION

The present invention relates to extendable storage elements, such as for example kitchen cabinets, shelves, and the like.

Storage elements of the above mentioned general type are known in the art. Such storage elements, for example kitchen cabinets, are usually held in a retracted position, and then when it is necessary to have easy access to their interior space, they are extended by a user to be located within its reach. Examples of such storage elements are disclosed in U.S. Pat. Nos. 2,635,030, 2,944,540, 3,059,984, 3,406,999, 3,415,586, 4,150,860, 4,150,861, 4,275,942, 4,714,305, 4,942,328, 5,029,935. The above listed elements are provided with complicated means for moving between extended and retracted positions.

SUMMARY OF THE INVENTION

Accordingly, it is an object of the present invention to provide an extendable storage element or the like, which is a further improvement of the existing elements of this type, and in particular has a simple construction of its means for moving between retracted and extended positions.

In keeping with this objects and with others which will become apparent hereinafter, one feature of the present invention resides, briefly stated, in an element having a body and means for moving the storage body between extended and retracted positions, wherein the moving means includes a motor drive and means for guiding the body during its movement between the positions and include two links connected with the body and connected with another part so as to move parallel to one another during the movement of the body between the extended and retracted positions.

When the storage element is designed in accordance with the present invention, its means for moving the storage body between the extended and retracted positions have a very simple construction and at the same time reliably perform the movement or conversion of the storage body between the above mentioned extended and retracted positions.

The novel features of the present invention are set forth in the appended claims. The invention itself, however, both as to its construction and its manner of operation , will be best understood from the following description of preferred embodiments, which is accompanied by the following drawings.

DESCRIPTION OF PREFERRED EMBODIMENTS

Figure 1:
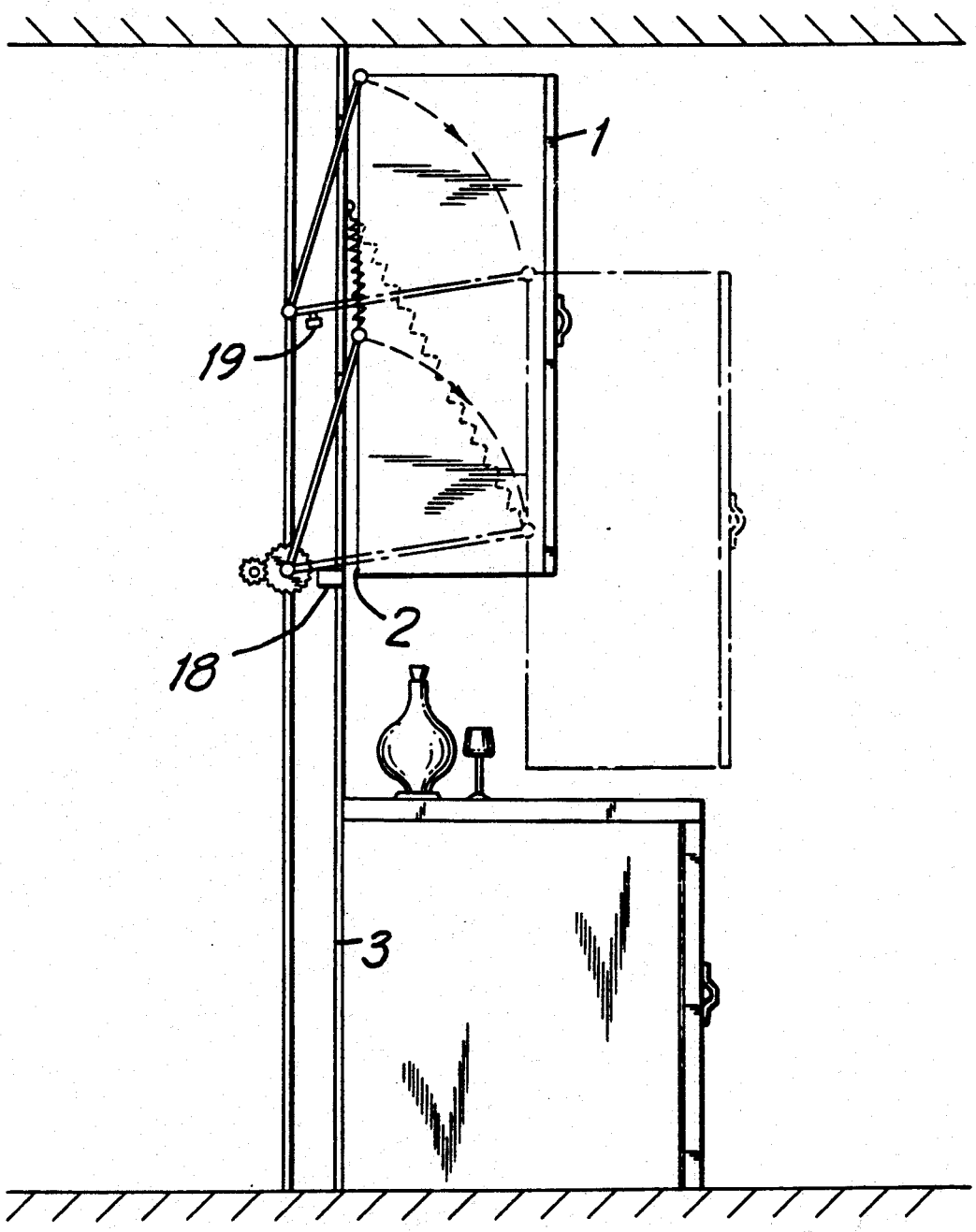
FIG. 1 is a side view of a storage element formed as a kitchen cabinet, in accordance with the present invention.
Figure 2:
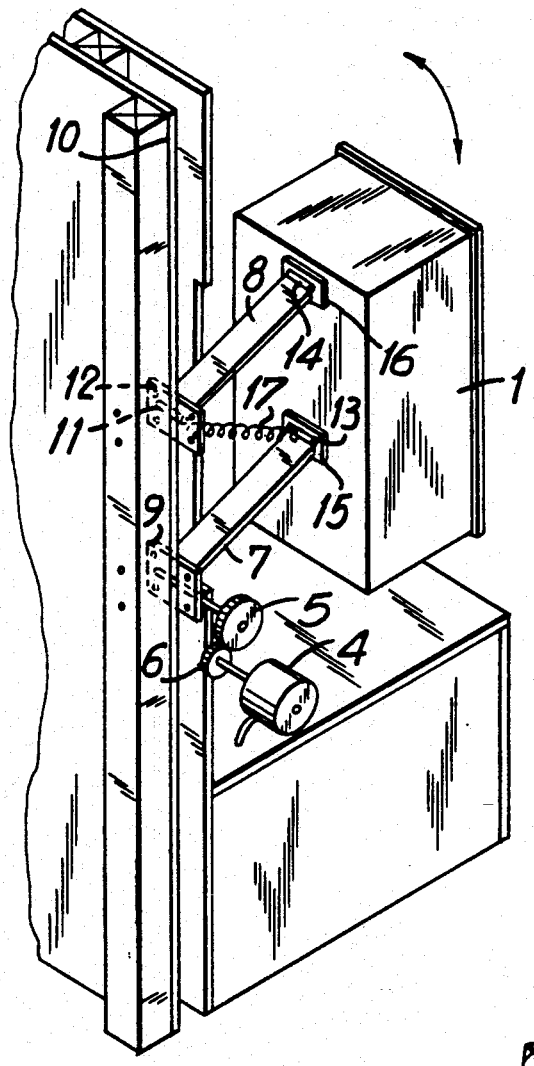
FIG. 2 is a perspective view of the litchen cabinet of FIG. 1, in accordance with the invention.

A storage element in accordance with the first embodiment of the present invention is shown in FIGS. 1 and 2. It has a storage body or cabinet which is identified with reference numeral 1. Since it is well known per se, it is not described here in detail. It can be formed as a well known kitchen cabinet or the like. The storage element is further provided with means for moving the body 1 between a retracted position in which it abuts with its rear wall 2 against a front kitchen wall 3 and an extended position in which it is located substantially lower to be easily accessible by a user, as shown in broken lines.

The moving means includes a motor drive 4 which preferably includes an electric motor and a worm-type reducer with a worm pinion and worm wheel engaging one another. The moving means further include a transmission with a spur gear 5 and a pinion 6 engaging one another. Finally, the moving means include two connecting links 7 and 8. The pinion 6 is mounted on the drive shaft of the drive unit 4. The gear 5 has an axle which is fixedly connected with a rear end of the link 7 and turns in a plate 9 attached to a rear wall 10 of the kitchen. The rear end of the link 8 is fixedly connected with an axle 11 which is turnable in a plate 12 connected to the rear wall 10 of the kitchen. The front ends of the links 7 and 8 ar pivotally connected by axles 13 and 14 with plates 15 and 16 fixed on the rear wall of the body 1.

A spring 17 has one end connected to the body 1 and another end connected to a stationary element, for example to the front wall 3. The first mentioned end of the spring can be connected, for example to the front end of the link 7 or to the plate 15.

The storage element formed as a kitchen cabinet of FIGS. 1 and 2 operates in the following manner.

In the retracted position the kitchen cabinet abuts with its rear wall 2 against the kitchen front wall 3 or at least is located close to it. When a user wants to have access to the interior of the cabinet, he or she lowers the cabinet. For this purpose the user turns on the motor drive 4 which through the transmission 5,6 turns the link 7 in clockwise direction, and the cabinet body 1 is moved forward and downward , being guided by the links 7 and 8 which move parallel to one another. In the lower position of the cabinet body the links 7 reaches the stop 18 and the cabinet cannot move any longer. The upper link 8 reaches an end switch 19 which turns off the motor drive 4. The user can now easily reach the interior of the cabinet body 1. During movement of the heavy body 1 downwardly, a very high torque is produced. The spring 17 partially counteracts the weight of the body and performs a balancing function, so that a less powerful motor can be used.

In order to retract the cabinet, the user activates a rotation of the motor in an opposite direction, which motor is reversible. The opposite-direction rotation of the drive motor is transmitted through the transmission 5.6 to the link which is turned in a counterclockwise direction and moves the body 1 upwardly and rearwardly till it reaches its retracted position. Since the motor is connected with the worm reducer, even when the motor is turned off in the retracted position of the body, the body cannot move toward the extended position by itself, since the worm reducer will block such movement. Another not shown end switch can be also provided to turn off the motor when the body reaches its retracted position.

Figure 3:
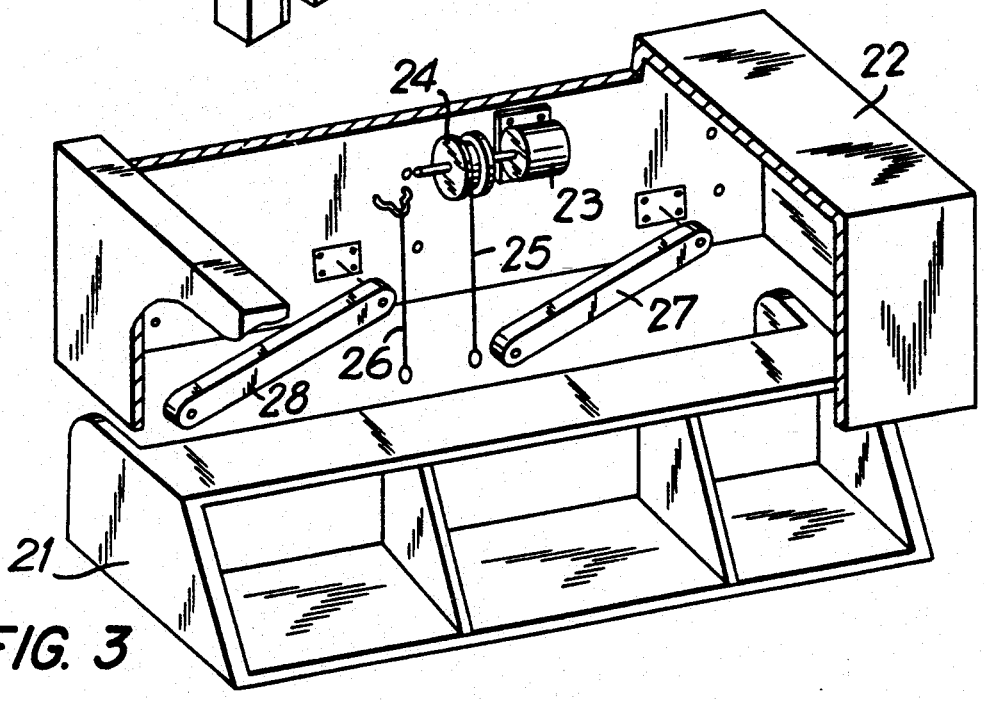
FIG. 3 is a perspective view of a shelf or space saver in accordance with the present invention.

In the embodiment of FIG. 3 a shelf or space saver has a body 21 movable between a retracted position in a structure 22 and an extended lower position located outside of the structure 22. A motor drive 23 has a drive shaft which carries a pulley 24 with an elongated element such as a rope 25 or the like. A free end of the rope is fixedly connected to the body 21. A safety elongated element, such as a rope 26 with a length somewhat exceeding the length of the rope 25 is connected with its ends to the structure 22 and the body 21 respectively. Two links 27 and 28 have first ends which are pivotally connected with the structure 22 and second ends which are pivotally connected with the body 21.

In order to move the body 21 from its retracted position to its extended position the motor 23 is turned on, the rope 25 is being unwound, and the body 21 lowers under the action of its own weight. The links 27 and 28 guide this movement. For moving the body 21 from the extended position to the retracted position the motor 23 is turned on in an opposite direction, it winds the rope 25, and the body is lifted. If for some reasons the rope 25 is broken, the rope 26 will not allow the body to fall down.

The present invention is not limited to the details shown , since various modifications and structural changes are possible without departing in any way from the spirit of the invention.

What is desired to be protected by Letters Patent is se forth in the appended claims.

I claim:

1. A storage element, comprising a body;

means for moving said body between a retracted position and an extended position, said moving means including a motor drive, and means for guiding said body during its movement between said positions, said guiding means consisting of links which move parallel to one another during the movement of said body between said positions; and means for stopping said body in said extended position, said stopping means including a stop arranged so that one of said links in said extended position reaches said stop and said body cannot move any longer, and an end switch arranged so that in said extended position another of said links reaches said end switch which turns off said motor drive, wherein said motor drive includes an electric motor and a worm reducer formed so that in said retracted position even when said electric motor is turned off said body cannot move toward said extended position by itself without being driven by said electric motor.

2. A storage element as defined in claim 1, wherein said links have first ends which are connected pivotally with said body at two vertically spaced points.

3. A storage element as defined in claim 2, wherein said links have second ends, said second end of one of said links being connected with said motor drive so that said one link is turned by said motor drive.

4. A storage element as defined in claim 3, wherein said second end of another of said links is pivotally connected to an immovable object.

5. A storage element as defined in claim 2, wherein said links have second ends which are pivotally connected to an immovable object.

6. A storage element as defined in claim 2, wherein said first end of one of said links is connected with an upper edge of said body, said first end of another of said links being connected with a middle portion of said body.

7. A storage element as defined in claim 1; and further comprising a transmission connecting said drive with said body and including a gear pinion and a gear wheel engaging one another.

8. A storage element as defined in claim 1; and further comprising a spring member having one end connected with said body land another end connected with an immovable object so that during the movement of said body from said retracted position to said extended position said spring member is stretched and then during movement of said body from said extended position to said retracted position said spring member compresses.

9. A storage element as defined in claim 1, wherein said motor drive includes an electric motor and an elongated element windable and unwindable by said motor and having a free end connected with said body, so that by winding of said elongated element and unwinding of said elongated element said body is moved from said extended position to said retracted position and from said retracted position to said extended position respectively.

10. A storage element as defined in claim 9; and further comprising a safety elongated element having one end connected to a stationary object and another end connected to said body, said safety elongated element having a length somewhat exceeding the length of said first mentioned elongated element.

11. A storage element, comprising a body;

means for moving said body between a retracted position and an extended position, said moving means including a motor drive, and means for guiding said body during its movement between said positions, said guiding means consisting of links which move parallel to one another during the movement of said body between said positions; and means for stopping said body in said extended position, said stopping means including a stop arranged so that one of said links in said extended position reaches said stop and said body cannot move any longer, and an end switch arranged so that in said extended position another of said links reaches said end switch which turns off said motor drive, said links having first ends connected pivotally with said body at two vertically spaced points, said second links having second ends arranged so that said second end of one of said links is connected with said motor drive so that said one link is turned by said motor drive, while the second end of another of said links being pivotally connected to an immovable object, said motor drive including an electric motor with a worm reducer; and a transmission connecting said drive with said body and including a gear pinion and a gear wheel engaging one another.

12. A storage element, comprising a body;

means for moving said body between a retracted position and an extended position, said moving means including a motor drive, and means for guiding said body during its movement between said positions, said guiding means consisting of links which move parallel to one another during the movement of said body between said positions; and means for stopping said body in said extended position, said stopping means including a stop arranged so that one of said links in said extended position reaches said stop and said body cannot move any longer, and an end switch arranged so that in said extended position another of said links reaches said end switch which turns off said motor drive, said motor drive including an electric motor and an elongated element windable and unwindable by said motor and having a free end connected with said body, so that by winding of said elongated element and unwinding of said elongated element said body is moved from said extended position to said retracted position and from said retracted position to said extended position; and a safety elongated element having one end connected to a stationary object and another end connected to said body, said safety elongated element having a length somewhat exceeding the length of said first mentioned elongated element.

* * * * *